United States Patent [19]

Ostertag

[11] Patent Number: 4,497,383

[45] Date of Patent: Feb. 5, 1985

[54] UNDERCUTTING DEVICE FOR ANCHOR HOLES

[75] Inventor: Alfred Ostertag, Celle, Fed. Rep. of Germany

[73] Assignee: Norton Company, Worcester, Mass.

[21] Appl. No.: 609,527

[22] Filed: May 14, 1984

Related U.S. Application Data

[63] Continuation of Ser. No. 405,498, Aug. 5, 1982, abandoned.

[30] Foreign Application Priority Data

May 15, 1981 [DE] Fed. Rep. of Germany ..... 3119605

[51] Int. Cl.[3] ..... E21B 7/28

[52] U.S. Cl. ..... 175/289; 82/1.5; 175/202; 408/159

[58] Field of Search ..... 175/173, 195, 202, 289, 175/286; 82/1.2, 1.5; 408/158, 159, 180; 166/55.3

[56] References Cited

U.S. PATENT DOCUMENTS

| | | | |
|---|---|---|---|
| 165,787 | 7/1875 | Bullock . | |
| 566,668 | 8/1896 | Davis . | |
| 1,007,330 | 10/1911 | Browder | 175/286 |
| 1,485,642 | 3/1924 | Stone . | |
| 1,720,942 | 7/1929 | Campbell . | |
| 1,880,216 | 10/1932 | Simmons . | |
| 2,152,008 | 3/1939 | Yarbrough | 166/55.3 |
| 2,243,131 | 5/1941 | Smith et al. | 175/195 |
| 2,280,769 | 4/1942 | Page | 51/184.1 |
| 3,283,405 | 11/1966 | Braswell | 82/1.2 |
| 4,153,121 | 5/1979 | Allan | 175/96 |
| 4,186,810 | 2/1980 | Allan | 175/96 |

FOREIGN PATENT DOCUMENTS

| | | |
|---|---|---|
| 2657849 | 7/1977 | Fed. Rep. of Germany . |
| 2928555 | 1/1981 | Fed. Rep. of Germany . |
| 1554730 | 10/1979 | United Kingdom . |

*Primary Examiner*—George A. Suchfield
*Assistant Examiner*—Michael Starinsky
*Attorney, Agent, or Firm*—Walter Fred

[57] ABSTRACT

A bore hole wall undercutting or reaming device in which a rotatable tubular support housing (1) (61) is adapted for rotation by drive means, has at least one circumferential guide slot in its side wall for receiving and guidingly supporting a cutting tool (4) (60) for movement outwardly to and inwardly from a cutting position. The cutting tool may comprise either a rigid and/or resilient slide or pivot lever (9) having a trailing end portion supporting a cutting member (10) thereon and a leading end portion connected to the housing by a single rigid, or pivotal pull type connection by which the housing tensions and pulls the cutting tool (4) around during a cutting operation. Adjustable cutting tool positioning means are provided which include an axially displaceable feed control rod (6) (63) with at least one camming surface thereon adapted to engage and displace the slide or pivot lever (9) relative to the housing and actuated by either one of a pair of relatively adjustable threaded members (26) (27) rotatably mounted on the housing or a tubular body (68) slidably mounted on the support housing and operable from a portion of the housing outside the bore hole.

20 Claims, 16 Drawing Figures

Fig.11
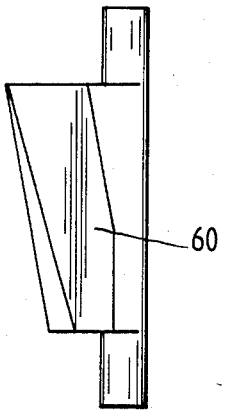
Fig.12
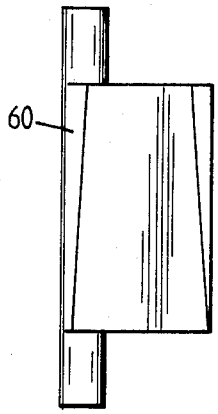
Fig.14
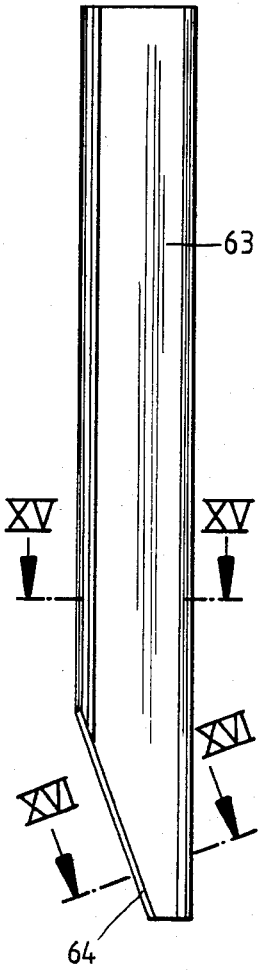
Fig.15
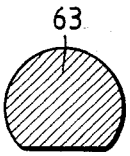
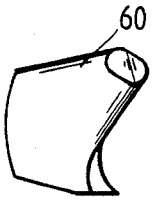
Fig.13
Fig.16
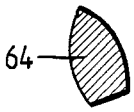

UNDERCUTTING DEVICE FOR ANCHOR HOLES

REFERENCE TO RELATED APPLICATIONS

This application is a continuation of application Ser. No. 405,498 filed Aug. 5, 1982 and now abandoned.

TECHNICAL DISCLOSURE

The invention relates to a device for reaming bores and particularly for undercutting anchor spaces or grooves in the wall about cylindrical holes bored into concrete, synthetic and natural stone to improve fastening of anchoring devices thereto.

BACKGROUND OF THE INVENTION

Bore holes in more or less homogeneous materials display a bore hole wall parallel to the bore hole axis, which is undesirable in numerous applications. This, for example, is especially true for anchor holes in synthetic stone, i.e., concrete, in which any anchoring device is to be secured. For this reason it is frequently desired in all possible types of borings to provide back cuts or relief in the bore hole wall to improve the fastening of anchoring devices in the bore hole such as anchor holes or to achieve widening for other purposes.

In similar devices disclosed in U.S. Pat. No. 4,153,121 (U.K. No. 1,554,730; DE-OS No. 2,657,849) and U.S. Pat. No. 4,186,810 (DE-OS No. 2,730,026), the carrier housing forms a cutting head, which can be installed in the bore hole in a predetermined position and rotated by means of a fluid pressure actuated drive. The cutting head radially encloses cutting tools which are extendable by means of fluid pressure actuated drives and intermittently movable from a rest position inside the crosssectional contour of the cutting head radially outward into an operating position, in which the cutting tool or member, formed as an impact cutting body, protrudes radially beyond the crosssectional contour of the cutting head and can work on the bore hole wall or partition in a reaming or undercutting manner.

For activation of the reaming or cutting tools, whose cutting member is formed as a single cutting body of tungsten carbide, a pressure actuated adjusting device is used, which may be operated from a location outside of the bore hole and which transmit radially oscillating, thrust or impact motions to the cutting tools.

These kinds of arrangements with radial linear motion of the cutting tools, require a relatively large diameter cutting head to house the radially directed pressure actuating piston. They are also attrition prone under the frequently harsh working conditions, because the radial guide surfaces which take and resist the tilting moments of force on the cutting tools are highly loaded, cause difficulties in the durable sealing of the pressure medium spaces and require considerable maintenance and repair effort, especially when it becomes necessary to replace used cutting members.

This invention provides an undercutting and/or reaming apparatus that can be manufactured and used within minimal constructional dimensions, has low production cost, is sturdy and provides easy tool changes and high reaming or cutting efficiency.

The invention solves the task or problem by providing various improvements in the distinguishing portions of an undercutting device and the significant arrangements thereof disclosed and claimed hereinbelow.

BRIEF SUMMARY OF THE INVENTION

The development of the undercutting device made according to the invention provides a rotatable tubular support housing for pivotal reaming or cutting tools which are pulled around and tensioned and free of tilting or bending moments during operation, appreciably simplifies and reduces construction costs, significantly reduces wear and the sensitivity of the device and which can even be utilized with and rotatably driven by devices which are used to cut or ream bore holes of relatively small diameters or crosssectional dimensions. Instead of vibration or thrust clearing, in which the stroke of the thrust piston controls the dimensions of the cleared bore hole region, the device according to the invention has positioning means adapted to axially displace a feed control cam shaft within the housing that gradually engages a pivot lever that swivels a cutting member thereon into the bore hole wall. Thus, the gradual, shock free feeding of the cutting member makes the employment of multiple cutting bodies in the cutting member possible, which in the usual case are not equal to thrust loading but on the other hand produce substantially higher removal efficiencies. At the same time the device permits the formation of very exact contours of the regions of the bore hole wall to be cleared, and the operation of the cutting tools is substantially simplified because they ascertain from the axially movable cam shaft only an outwardly directed swivel or pivotal feed motion. A separate retracting drive for resetting them back into and within the contour of the support housing is not required. Moreover, the cutting tools, which may be spring biased inwardly, carry out a self-acting retracting motion in interacting with the bore hole wall, as soon as the feeding movement of the adjusting device is discontinued and during the return thereby of the feed control cam shaft to its initial starting axial position relative to the housing. Numerous additional details and advantages follow from the subsequent description and drawing in which one or more embodiments of the invention are disclosed in greater detail.

BRIEF DESCRIPTION OF THE DRAWINGS

FIG. 11 is a trailing end view of a cutting tool with upper plane and inclined outer cutting surfaces on the cutting member and an inner cam engaging surface on the pivot lever with projecting studs;

FIG. 12 is an outer side view of the cutting tool of FIG. 11;

FIG. 13 is a vertical view of FIG. 11 showing one of the studs on the pivot lever of the cutting tool shown in FIGS. 11 and 12;

FIG. 14 is a side view of the feed control rod with a cutting tool camming surface at its lower end;

FIG. 15 is a crosssectional view taken at line XV—XV in FIG. 14; and

FIG. 16 is a crosssectional view of the camming end portion taken at line XVI—XVI in FIG. 14.

DETAILED DESCRIPTION OF THE INVENTION

Figure 1:
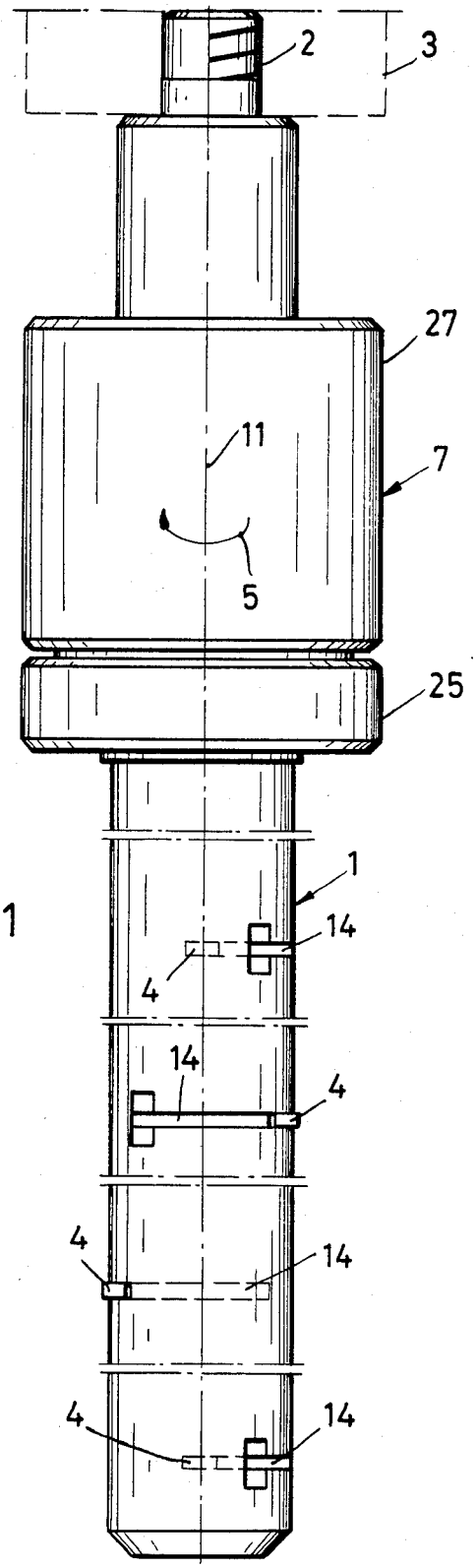
FIG. 1 is a total side view of a device according to the invention.
Figure 2:
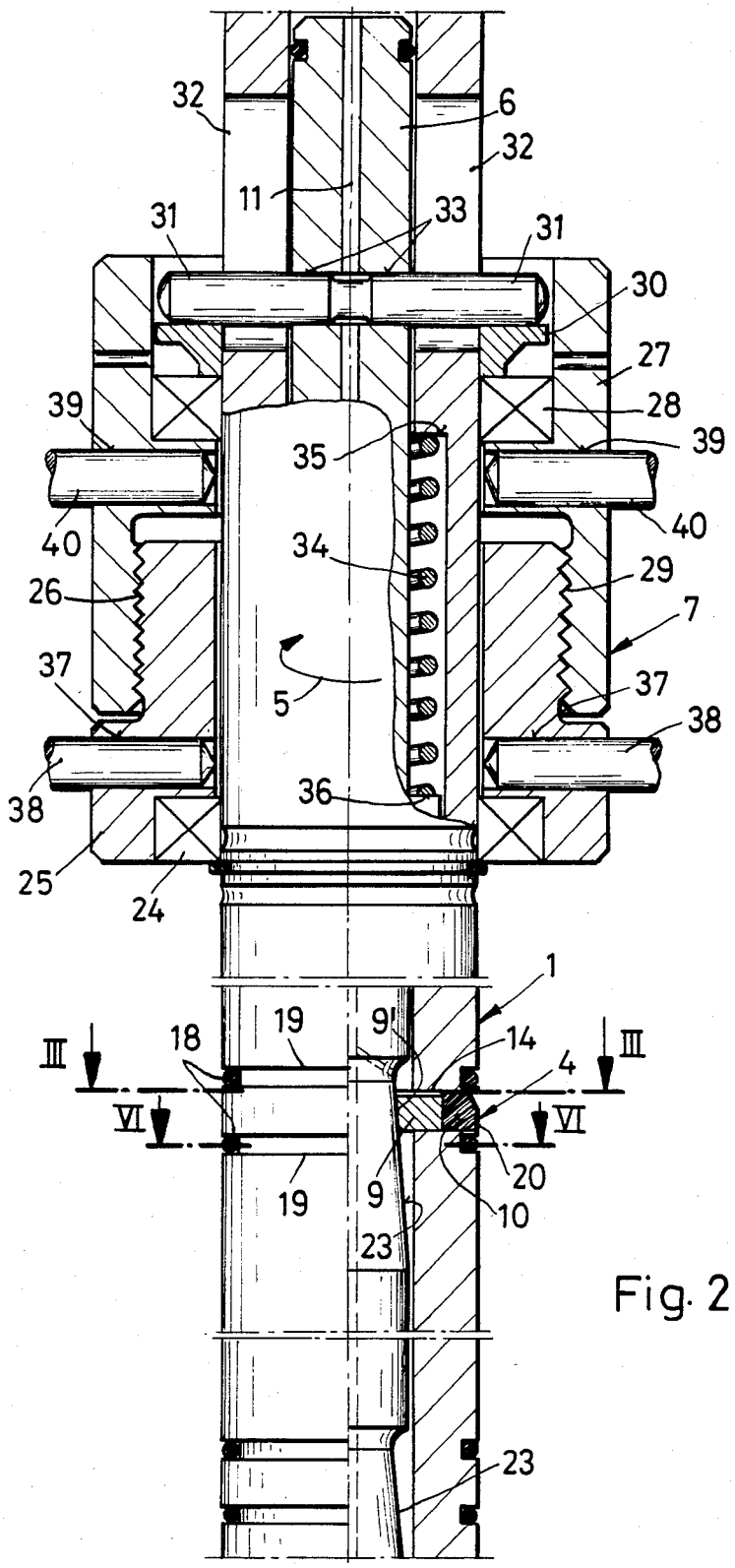
FIG. 2 is a partial sectional view through the upper and lower regions of the device according to FIG. 1.

To begin with, as FIGS. 1 and 2 show in detail, the device comprises a tubular support housing 1, whose outside diameter is only slightly less than that of the bore hole in which the undercutting, reaming, scraping or clearing work on the wall thereof is to be carried out. The support housing 1 is provided with a connecting drive shaft 2, which is insertable into a rotatable drive means, e.g., a drive chuck or coupling of a drill or motor as would be used initially to establish the bore hole and indicated schematically at 3.

Reaming, cutting or scraping tools 4 are housed in the support housing 1, and, for reasons of force equalization, are arranged in uniform or equal central angle divisions over the circumference of the support housing 1 and thereby are simultaneously equally axially displaced or spaced along it length. For the time being, only one cutting or scraping tool 4 is provided in the illustrated example inside the same circumferential plane of the support housing 1, but it is understood that many cutting, reaming or scraping tools may be attached to the support housing 1 even inside the same circumferential plane, i.e., located at the same axial elevation, when the dimensional conditions permit this.

During an operating rotational motion in the direction of the arrow 5 of the support housing 1, the cutting tools 4 are movable from an inner retracted inoperative rest position inside the crosssectional contour of the support housing toward the outside into a working position. Positioning means including an axially movable adjusting device 6, located in the support housing 1, is provided for outwardly feeding and advancing the cutting tools 4. The adjustable cutting tool feeding device 6 can be actuated by means of an actuating device 7 situated outside the bore hole 8.

Figure 3:
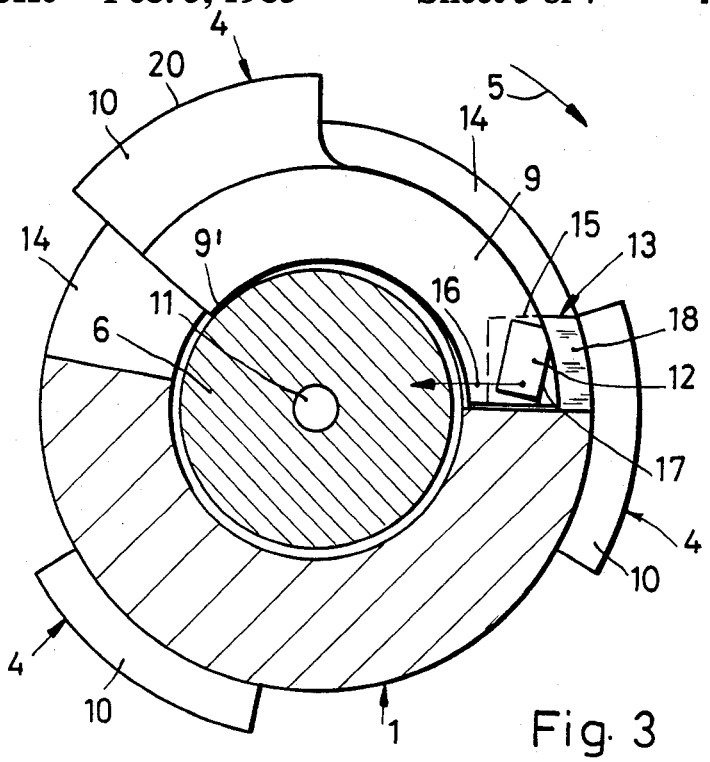
FIG. 3 is a simplified cross-sectional view taken at the line III—III in FIG. 2.
Figure 4:
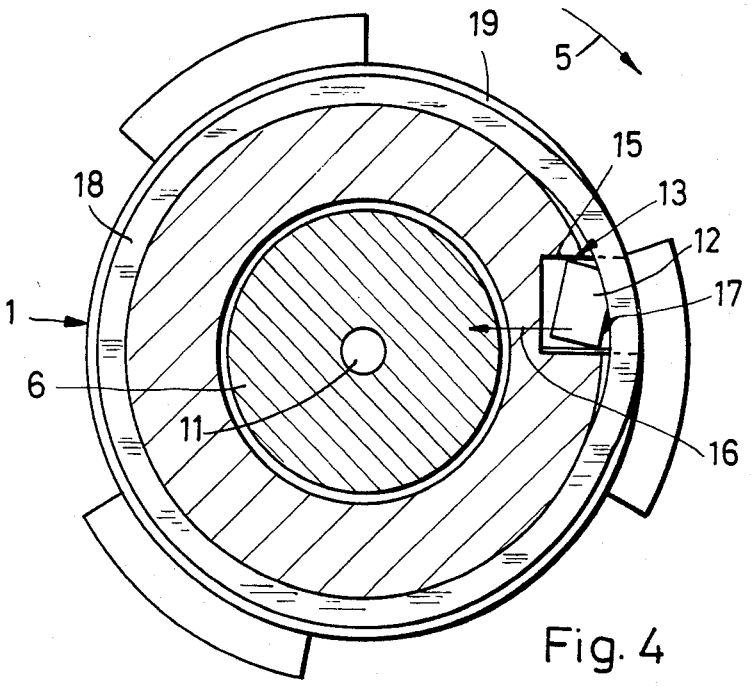
FIG. 4 is a simplified cross-sectional view taken at the line IV—IV in FIG. 2.
Figure 5:
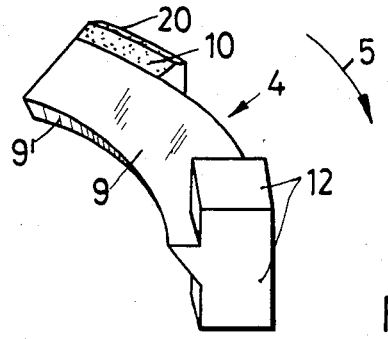
FIG. 5 is a separate representation in perspective of a reaming, scraping or cutting tool.
Figure 6:
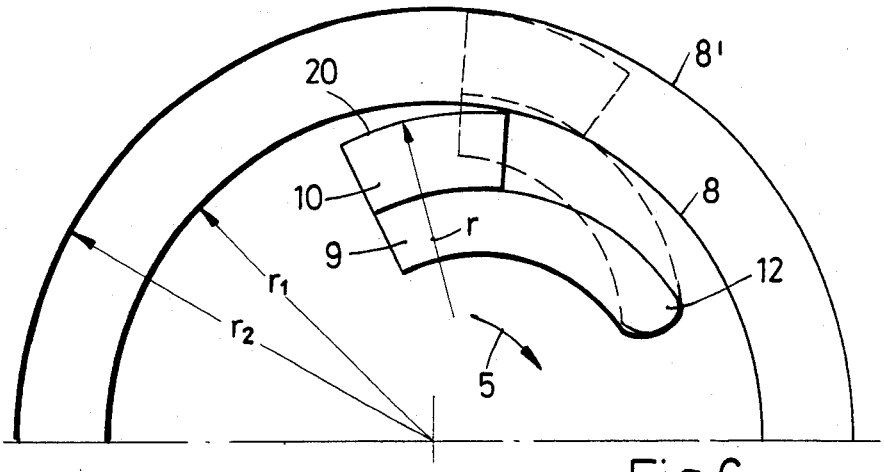
FIG. 6 is a schematic half crosssectional view to illustrate the operating motions of a scraping tool with a solid cutting member.

As can be inferred in detail especially from FIG. 3 to FIG. 5, each cutting, reaming or scraping tool 4 comprises a support arm 9 as well as a cutting member 10 supported by it. The support arm 9 is formed as a slide arm of arcuate shape slideably supported within an arcuate slot in the side wall of the support housing 1 and is outwardly and inwardly displacable in a plane of motion which intersects with and cuts the support housing 1. In the illustrated examples, the plane of motion of the slide arm 9 cuts the longitudinal central shaft or axis 11 of the tool support housing 1 at a right angle, however, the plane of motion of the slideable support arm 9 can cut the longitudinal central shaft or axis 11 of the support housing at an angle which varies somewhat from 90°.

Preferably, the slideable support arm 9 is formed as a stiff pivoted lever 9, pivotably located in the support housing 1 and extending in its plane of motion over a portion of the periphery of the support housing 1. However, a slide arm 9 made entirely or partially of resilient spring material can be provided instead with the forward or leading end thereof, which precedes its trailing or rear end in the operating rotational direction 5, solidly connected or fixed to the support housing 1 as by clamping. In this case the slide arm 9 is displaceable in a swivel or pivot like motion relative to the support housing 1 and is under the influence of a tensile force of elastic material deformation occuring in at least a partial region of its length.

A pivotable connection of the pivot lever 9 may comprise a spring piece, which defines a pivoting axis or region, extending between the slide piece of the pivot lever 9 and the support housing 1 and which can be connected solidly on one side or end to the support housing 1 and on the other opposite side or end solidly with the leading end of the slide piece portion of pivot lever 9 which precedes the trailing end thereof in the operating rotational direction 5 of the support housing. Lever designs which employ a spring as the slide piece or as a part of a slide piece which includes a relatively stiffer portion of the pivoted lever 9, require a rigid connection with the support housing 1. This also applies to a possible design in which the leading end of the pivot lever 9 which precedes its trailing end in the operating rotational direction 5 is rotatable around a pivot axis defined by an inner, closed to the outside pivot bearing of the support housing 1. Such a pivoted bearing may for example be formed by a drilled hole directed more or less axially in the side wall of the support housing 1, for receiving a cylindrical pivoted stud therein that engages the pivot lever 9.

In the interest of providing easy interchangability and replacement of tools 4 in the illustrated preferred designs, the pivot lever 9 of every reaming or cutting tool 4 is provided on its leading end which precedes its trailing cutting end in the operating rotational direction 5 of the support housing 1 with an articulatable or pivotable end boss or stud 12 which protrudes axially on one or both sides of the lever. The lever 9 is supported with the pivotable stud extending into a bearing pocket 13 cut or sunk into the housing wall and which is open to an entrance at the outer periphery of the support housing 1. The slideable pivot lever 9 abuts or adjoins slide surfaces of the housing at opposite sides of an open peripheral arcuate groove 14 in the side wall which leads axially on both sides to the pivot lever 9. In the illustrated example the bearing pocket 13 at the leading end of the generally T-shape groove or slot 14 exhibits an essentially rectangular form in crosssection with dimensions that exceed those of the similarly shaped articulatable stud 12, so that stud 12 is easily inserted into its bearing pocket 13 from the outside and has play of motion permitting it to make pivotal motions in its plane of motion. The bearing pocket 13 exhibits a bearing and driving surface 15 in the housing wall that is situated on its trailing side facing the operational rotational direction 5, which, during operation of the device, exerts a reaction force on the pivotal stud 12 of the pivot lever 9 with a vector directed inwardly with respect to the support housing 1 as indicated by 16. With a flat bearing and driving surface 15, this can be achieved by bending or positioning the stud 12 so its inner edge corner contacts drive surface 15 and its surfaces are inclined forward at a small acute angle in the operating rotational direction 5, relative to an assumed radial surface and the bearing pocket 13 as shown in FIGS. 3 and 4.

The articulatable stud 12 can also have a cylindrical bearing region different from its illustrated crosssectional form, in which case the bearing and driving surface 15 of the bearing pocket 13, encloses a partly cylindrical bearing shell.

In the illustrated example, the outside of the articulatable stud 12 has a reset or release surface region 17, which changes its radial distance relative to the longitudinal central axle 11 during a pivoting or swinging motion of the pivot lever 9. By this means it is possible, to produce an inwardly directed swinging force through an action directed from the outside inward onto the resetting surface region 17 to retract and secure the pivot lever(s) 9 in their retracted or reset rest position(s) especially when being transported and during non-operating periods. A resilient annular retaining spring or ring 18 is provided for this purpose in the illustrated design example, which is formed as a ring or a ring element shaped spring body such for example is a resilient rubber ring spring. Thereby the annular retaining spring 18 is arranged and retained in a circumferential groove 19 of the support housing 1 which intersects the bearing pocket 13. In one development of the pivot lever 9 with an articulatable stud 12 which projects on both sides, two retaining springs 18 are arranged in corresponding axially spaced circumferential grooves in the support housing 1, which, may extend axially the height of or to the end of the stud or pin 12.

In the development of the reaming, scraping or cutting tool according to FIGS. 3 to 6, the cutting member 10 is rigidly secured to the outside of the pivot lever 9. The cutting member 10 is preferably formed as a multiple cutting body, which has cutters, cutting elements or particles with cutting edges thereon aligned across the operating rotational direction 5, which project over the exterior sides and outside surface of the trailing end portion of the pivot lever 9 that lags in the operating rotational direction 5 of the support housing 1, which are turned toward the bore hole wall and which have curved exterior cutting surfaces 20 which run approximately in the operating rotational direction. Such a manifold or multiple cutting body can be fashioned of a diamond studded component or can consist of a shaped body of a matrix interspersed with natural or synthetic diamonds or particles of any other suitable well known hard cutting material. In the development of the cutting member 10 as a multiple cutting body, the bend or curvature of the curved exterior cutting surface 20 is preferentially the same as or less than the bend or curvature of the wall of the initial uncut or uncleared bore hole 8, so that the exterior cutting surfaces 20 attain an even or uniform operational contact with the substance to be cleared to the greatest extent possible over their entire length. Thus, the surface region of the exterior cutting surface 20 in effective working contact with the substance to be cleared, shifts, as shown, for example, in FIG. 6, from the leading or forward end portion in the operating rotational direction 5 to the trailing or rear end portion of the cutting member 10. If the curvature of the exterior cutting surface 20 is an arcuate segment of a circle with a radius of curvature r, then this radius r is smaller than the initial radius of curvature $r_1$ of the uncleared bore hole wall 8 and correspondingly also smaller than the radius of curvature $r_2$ of the finished bore hole wall 8' in the region being cleared.

The cutting member 10 comprises preferentially at least one side cutting surface which is also usuable in the axial direction of the bore hole 8, especially when the device is to be used to make cleared regions of greater axial width than the cutting members 10 by axially displacing the rotating support housing 1. However, both of the axially opposite facing side surfaces of the cutting member 10 preferentially form side cutting surfaces, which occurs naturally with cutting members 10 made of a shaped body with diamond or similarly hard material studded particle matrix.

A cutting member 10 which, in accordance with FIGS. 3 to 6, is connected solidly with the trailing end portion of the pivot lever 9, can also be formed as a simple cutting body having a leading front face including a cutting edge which faces in the operating rotational direction 5 of the support housing 1, and a configuration or contour line which projects over the exterior circumferential surface of the pivot lever 9. In this case the simple cutting body has exterior peripheral and side surfaces which join and extend at a slight clearance or relief angle away from the cutting edge on the front side and opposite the operating rotational direction 5.

Figure 7:
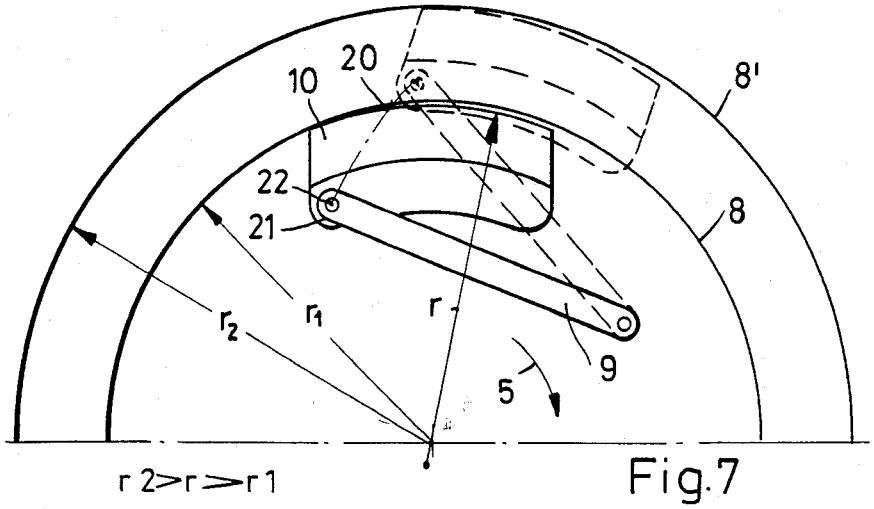
FIG. 7 is a representation similar to FIG. 6 of another scraping tool with a freely tiltable cutting member pivotally mounted at the end of a pivot lever.

However, as schematically shown in FIG. 7 the cutting member 10 designed as a multiple cutting body may be supported on a body pivotally attached to a pivot lever 9 and to tilt or pivot to a limited degree. This is achieved by means of a support body 21 pivotally connected to the trailing end of lever 9 extending around a movable axis of a connecting pivot stud or pin 22 aligned vertical or normal to the plane of motion of the pivot lever 9 about the axis of a pivot stud pivotably connecting the opposite leading end of the lever 9 to the housing 7. In this alternative arcuate design, the radius of curvature r of the circular arc shaped or curved exterior or peripheral cutting surface 20 of the cutting member 10 is preferentially greater than the initial radius of curvature r1 of the wall of the uncleared bore hole 8 and smaller than the radius of r2 curvature of the finished bore hole wall 8' in a finished cleared or groove region thereof. In the interest of achieving the most favorable operational contact of the exterior cutting surface 20 with the surface or wall of the bore hole 8 to be cleared or cut, the pivot, or tilt axis of pivot stud 22 and support 21, is arranged relative to the operating rotation direction 5 of the support housing 1, appropriately in the rear or trailing end region of the cutting member 10 and the lever 9.

As particularly shown in FIG. 2, the cutting tool adjusting means or device comprises an axially displacable and securable feed control rod or shaft 6 mounted in the tubular support housing 1, and which is provided with a tapered, inclined, wedge shaped or conical cam surface 23 adapted for sliding engagement with the inner side or surface (9') and feeding of the pivot lever 9 at every clearing or cutting tool 4. The feed control rod 6 is axially displaced relative to the housing by a screw driven operating or actuating means or device 7, including a first or lower bushing 25, with an exterior thread 26, and an annular ring or shoulder coaxially rotatably supported by means of a bearing 24 on the support housing 1. A second or upper axially moveable rotatable bushing 27, is rotatably supported by a bearing 28 coaxially on the support housing 1 and threadable onto the first bushing 25 by means of an inner thread 29. The bearing 28 and supporting bushing 27 are axially displacable along and relative to the support housing 1, and, at the same time, provide a lower support for an annular spacer or ring 30, whose upper side supportingly engages two radial, diametrically arranged driving pins or pin end portions 31. The pins 31 extend through axially elongated slots 32 in the support housing 1 wall and lock into holes 33 in the control rod 6. Resilient means such as a thrust or compression coil spring 34 is arranged in an annular cylindrical chamber between the support housing 1 and the control rod 6. The spring 34 extends around the control rod 6 and axially into engagement at one end with an annular inner shoulder 35 of the support housing 1 and on the other end with an annular exterior collar or shoulder 36 on the control rod 6, to displace the control rod 6 toward the bore hole bottom and relative to the tool support housing 1. Radial bolts or rods 38 are insertable into radial holes 37 of the lower bushing 25, by means of which the lower bushing 25 together with the upper bushing 27 can be held and prevented from rotating when the support housing 1 rotates. The upper bushing 27 has radial holes 39 as well, in which radial rods or bolts 40 are also insertable. The upper bushing 27 can be turned or rotated and adjusted axially relative to the lower bushing 25 by means of the radial bolts 40 and the engaging screw threads 26 and 29 thereof independent of any rotation of the support housing 1. By means of the adjustable screw connection, bushing 27, bearing 28, spacer 30, and pins 31 the control rod 6 is displaceable axially either upward relative to the support housing 1, to compress spring 34 and impart an outward infeed motion to the cutting tools 4, or downward, with the help of spring 34 to retract and reset the cutting tools inwardly back into the contour of the support housing 1 following a clearing or cutting operation.

To carry out reaming or cutting operations, the device, with its cutting tools 4 retracted inside the contour of the support housing 1, is inserted into the bore hole to a depth at which the cutting tools 4 are located and supportingly maintained in a suitable conventional manner opposite regions to be cleared in the bore hole. The device is then set in rotary motion by actuating the drive means 3 coupled to the drive shaft. Upper bushing 27 is to be rotated by means of rod 40 relative to bushing 25 to cause axial displacement of the feed control rod 6 in an upward direction relative to the rotating housing 1 and from its position illustrated in FIG. 2. The slidably engaging cam surfaces 23 of the axially moving feed shaft 6 now press gradually against corresponding inner mating surfaces 9' of the pivot lever 9 and thereby displace or cam the cutting tools radially outwardly toward the bore wall.

Figure 8:
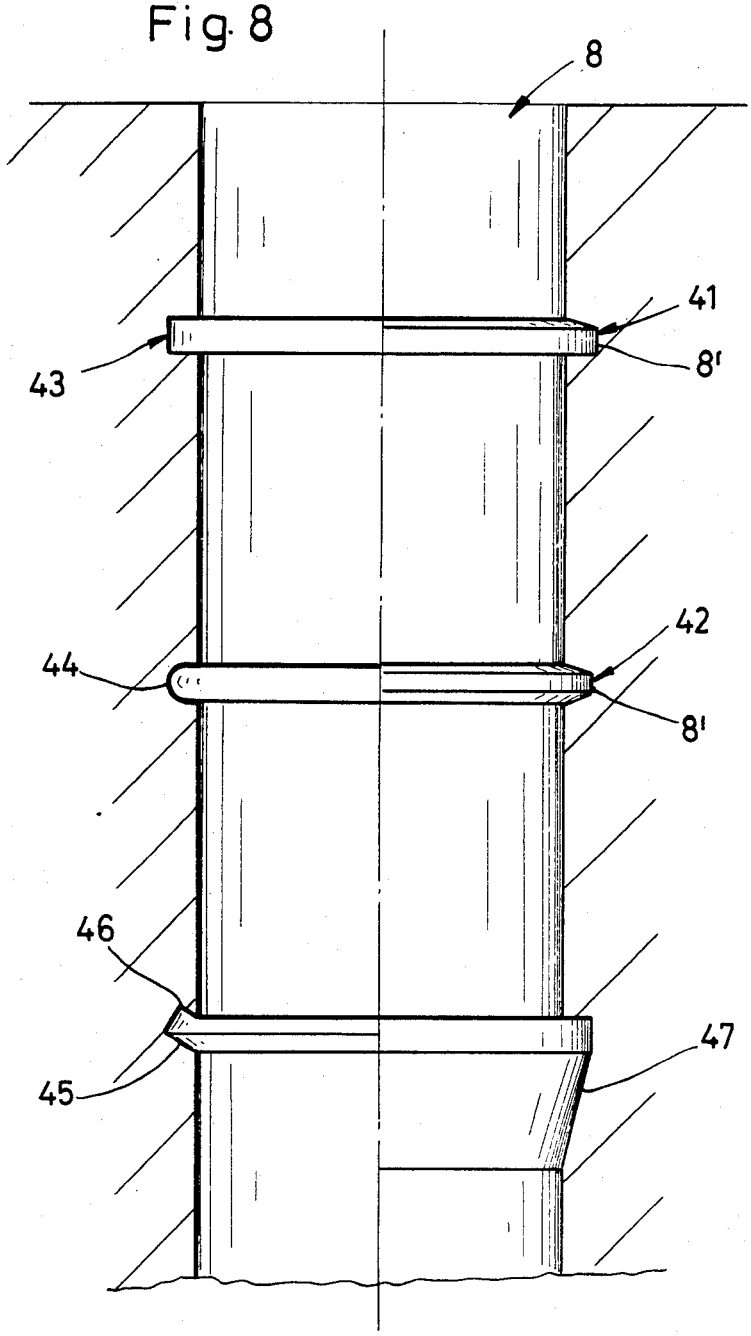
FIG. 8 is a schematic crosssectional view of a bore hole with cleared, groovelike or slotlike regions.
Figure 9:
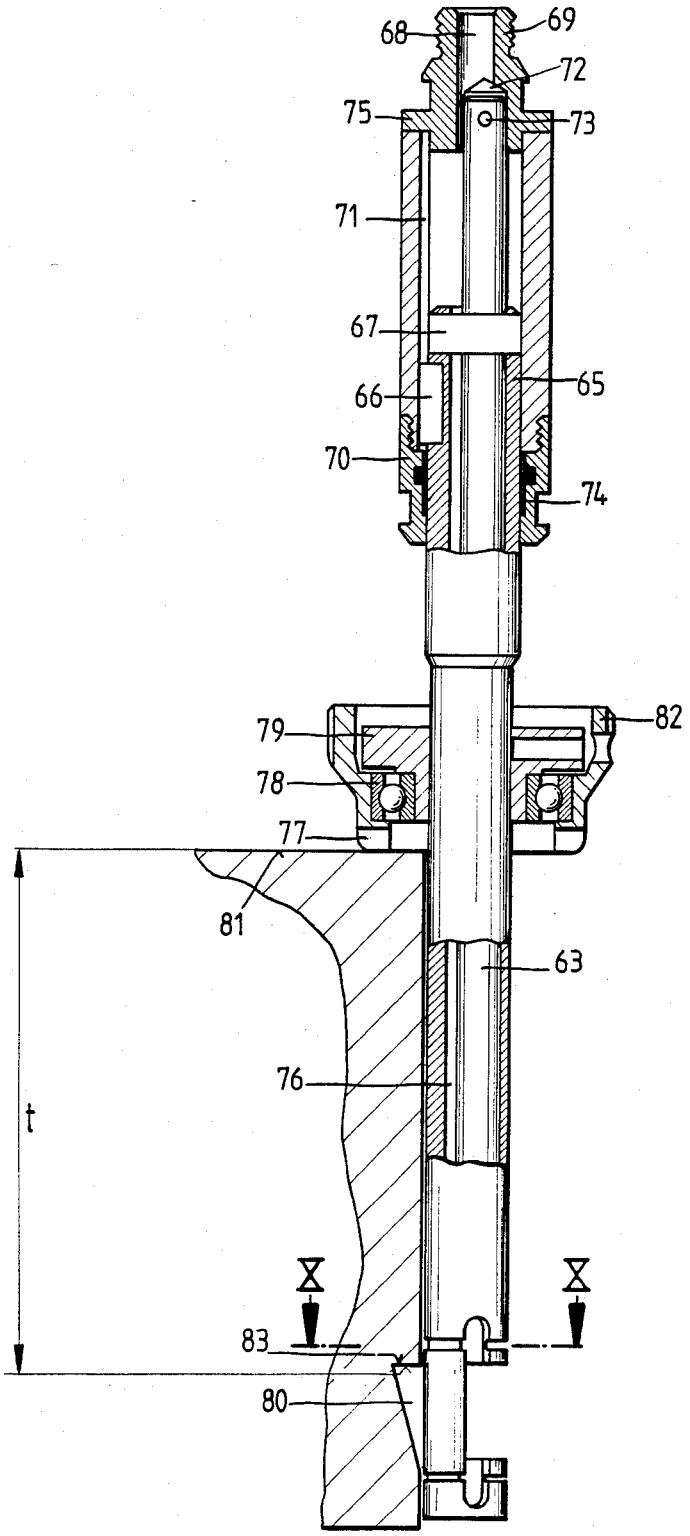
FIG. 9 is a total side view partly in section of another embodiment of the invention.
Figure 10:
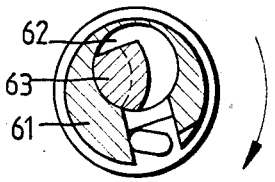
FIG. 10 is a crosssectional view taken at line X—X in FIG. 9.

Accordingly, the cutting tool(s) 4 swivel outwardly in their plane(s) of motion, and gradually feed the cutting member 10 into working contact with the bore hole wall. Insofar as the rotating support housing 1 is being supported against and does not experience an axial motion during infeed, the cutting members 10 will produce, as shown in FIG. 8 radial grooves 41, 42, 43, 44 in the bore hole wall 8 according to the cross sectional form of the cutting members 10, insofar that the plane of motion for the cutting tool(s) 4 is about 90° to the longitudinal center or axis 11 of the support housing 1. The side walls 46 of the groove 45 are at an angle differing from 90° to the wall of the bore hole 8.

Finally, a relieved or undercut region illustrated at 47, in FIG. 8 and of greater axial width than the cutting member 10 can be produced by simultaneously traversing support housing 1 axially and either feeding or retracting the cutting tool 4 toward or from the deepest radial point of the undercut. To retract the cutting tools 4, the feed control rod 6 is moved by spring 34 downward relative to the support housing 1, by threading the upper bushing 27 onto lower bushing 25, whereby the pivot levers 9 are progressively automatically freed and allowed to retract inwardly by the decending cam surface(s) 23, and the resulting radial force or reaction of the bore hole wall on the cutting members 10. The rate of feed or retraction being controlled by the rate of axial displacement and movement of the cam surfaces 23 of the control rod 6.

After each reaming operation, the control rod 6 is again displaced to its original position illustrated in FIG. 2, by which means all of the cutting or reaming tools 4 return to their rest position inside the contour of the support housing 1. Thus the device is thereafter removed from the bore hole 8, the cutting members 10 can be inspected and, in case that wear or damage has occured, the tools 4 can be removed as a whole from its bearing pocket 13 and replaced by new or other cutting tools 4. The simple interchangability of the cutting tools 4 is a practical exceptional essential advantage, since used cutting tools 4 can not only be replaced quickly and easily, but can also be replaced by cutting tools of another type and with various other forms of cutting members.

Another embodiment of the invention is shown in FIGS. 9–16 wherein the undercutting or reaming device may support one or more but in this instance is adapted to support a single cutting tool 60 substantially identical in most respects to the cutting tool (4). The cutting tool (60) which in this instance is of relatively greater axial width, and shorter arcuate length, also has articulatable studs or pins projecting from opposite sides of a leading end portion of a slide or pivot lever and a preformed cutting member with a plane upper horizontal and an inclined circumferentially curved exterior cutting surface attached to a trailing end portion of the slide or pivot lever as described hereinbefore.

However, in this embodiment the tubular housing 61 has an eccentric bore 62 for receiving an axially displacable partly circular feed control rod 63, of the positioning means, having a flat side and a curved wedge shape camming surface 64 at a lower end portion thereof, as shown in FIGS. 14–16, that engages and displaces the cutting tool (60) outwardly. As before the housing 61 has adjacent its lower end a circumferential guide slot and bearing pockets at a leading end portion therein for receiving and pulling the cutting tool 60 around and annular grooves for annular resilient retaining springs (not shown) that inwardly bias and retain the studs in the bearing pockets which together provide a pull type connection between the housing 61 and cutting tool 60.

The feed control rod 63 extends upwardly through an upper or outer enlarged portion 65 of the tubular housing to which a key 66 and an annular sleeve bearing or guide ring 67 are fixed and through the guide bearing 67 to its upper end portion attached to axially displacable, rotatable and telescopically arranged actuating means. The actuating or operating means comprises a telescopic tubular slide or body assembly 75 including drive or coupling means 69 fastened to the upper end thereof and adapted for connection to conventional rotary drive means, an intermediate cylindrical or tubular body or slide portion including an internal keyway 71, bore and surface slideable over the key 66, guide 67 and upper portion 65 of the housing. Also, a packing or box nut 70, including an annular spring biased seal and guide bearing 74 therein, is threaded to the lower open end of the tubular body. The upper end of the feed control rod or cam shaft 63 extends into an eccentric bore 72 in the upper coupling portion 69 attached thereto by a set screw or pin 73 and is axially displaceable with the tubular body 75, relative to the guide bearing 67, the housing 61 and the cutting tool (60).

The annular spring biased seal and guide bearing in packing nut 70 functions to seal off and prevent the escape of coolant fluid or water which may enter a passage between centre bore 68 (of tubular body) 75 and control rod 63 and continue on through a passage in the annular guide ring 67, a passage 76 between a flat or cut-off side of the feed control rod 63 and the eccentric bore to the cutting tool 60 and exit upwardly around the housing 61 and out radial passages in an adjustable stop ring 77 of stop means about the housing 61.

The stop ring 77 has a bottom surface adapted to rest against the exterior surface about the entrance of a bore hole and an outer peripheral surface adapted to be held against rotation by hand or a suitable tool.

A ball or roller bearing 78 is mounted between the stop ring and a clamping ring 79 which may be adjustably fixed by a set screw to rotate with the tool support housing 61 relative to the stop ring 77.

A clearance hole in the upper annular wall 82 of the stop ring 77 allows access to a set screw for adjusting the axial position of the rotatable clamping ring 79 and the stop ring 77 relative to the housing 61 and cutting tool 60 to cut a groove 80 at a predetermined desired axial distance or depth t from the supporting surface 81 about the entrance to the plane upper side 83 of the groove 80 cut into the bore hole wall. Thus, the adjustability of the stop ring allows for cutting grooves in bore hole walls repeatedly at the same depth and at different depths as well.

The operation of the latter or second embodiment of the invention is similar in many respects to the first embodiment and comprises adjusting the stop ring 77 to the desired depth t, inserting the device into the bore hole until stop ring rests upon concrete surface 81, connecting the coupling 69 to the chuck or drive spindle of a suitable conventional rotary drive means, actuating the rotary drive means whereby the device is rotatably driven relative to the stationary and frictionally held stop ring 77 and pushing or displacing the drive means and the rotating tubular body 75 down or axially toward the stop ring 77 and thereby axially telescope the body 75 and attached feed control rod 63 relative to the rotating housing and thereby displace the cutting tool 60 outwardly into cutting engagement with the bore hole wall.

Upon completion of a cutting operation the drive means is deactuated to stop rotation and then pulled outwardly whereby the attached telescopic body 75 and feed control rod are pulled upwardly or axially away from and relative to the stop ring 77, and housing 61 fixed thereto. The axial movement of the feed control rod 63 and its camming surface 64 to the initial reset or start position allows the resiliently inwardly biased cutting tool (60) to retract to the initial starting position within the contour of the housing 61 and hence removal of the device from the finished bore hole.

What is claimed is:

1. A device for undercutting a wall about a bore hole comprising:

a rotatable tubular support housing adapted for insertion into a bore hole, to be coupled to and rotated by rotary drive means, and having at least one circumferential guide slot including an entrance thereto situated between axially spaced slide surfaces extending circumferentially in a portion of the support housing and inwardly from the entrance to the circumferential guide slot, and pull type connector means including at least one bearing pocket with a peripheral side entrance and a driving trailing side surface, of the support housing, adjoining the bearing pocket and facing in a leading working direction of the support housing, adjoining and extending inwardly from the peripheral side entrance and axially from one of the slide surfaces and situtated solely at a leading end portion of the circumferential slot whereby the support housing is adapted to receive, support, engage, guide and pull around at least one cutting tool insertable and swivelable in the guide slot from a retracted position outside the cross sectional contour of the support housing and back to the retracted position;

a cutting tool including a cutting member and a pivot lever supporting the cutting member on a trailing end portion thereof, slideably mounted in between the slide surfaces of the tubular support housing, swivelable inwardly and outwardly in a plane of motion that intersects with the support housing and which has a pull type connection with the support housing only at its leading end portion which precedes the cutting member during rotation in a working rotational direction by a predetermined circumferential distance, including at least one stud extending axially from the leading end portion and inserted, by way of the side entrance, into the bearing pocket and the stud having a side surface extending toward the working rotational direction and away from the driving trailing side surface and a portion of the stud drivingly engaged by the driving trailing side surface which during rotation exerts on the stud a reaction force with an inwardly directed vector relative to the support housing whereby the cutting tool is easily removed and replaced solely by way of the side entrance, constantly forced inwardly toward the retracted position, pulled around by the support housing and placed in tension during a cutting operation;

positioning means in the support housing and operable from a region of the device outside the bore hole for positioning and moving the cutting tool into cutting engagement with the bore hole wall including a feed control rod axially displaceable in the tubular support housing and having a camming surface adapted for engaging and displacing the pivot lever; and actuating means supported by the support housing for axially displacing the feed control rod relative to the housing and thereby adjusting the position of the pivot lever and cutting member thereon in the plane of motion.

2. A device according to claim 1 further comprising:

a reset surface region on the stud which changes its radial distance relative to the longitudinal central axis of the support housing during pivotal movement of the pivot lever, and resilient means about the housing for retaining the stud in the bearing pocket of the support housing.

3. A device according to claim 2 wherein the resilient means comprises:

an annular spring extending around the support housing and acting against the reset surface of the stud.

4. A device according to claim 3 wherein the actuating means further comprises:

resilient means adjacent the housing for biasing the control rod relative to the housing in an axial direction that allows retraction of the cutting tool back into the housing.

5. A device according to claim 1 wherein the cutting member comprises:

a plurality of cutting bodies having cutting edges aligned transverse to the operating rotational direction in a curved exterior cutting surface which extends circumferentially over a trailing end portion of the pivot lever and faces the bore hole wall.

6. A device according to claim 5 wherein the curved exterior cutting surface has a radius of curvature no greater than that of the wall of an initial uncut bore hole.

7. A device according to claim 5 wherein the cutting member further comprises:

at least one side cutting surface for cutting in an axial direction the bore hole wall.

8. A device according to claim 5 wherein the cutting bodies are dispersed in and fixed to the cutting member and comprised of relatively hard cutting material adapted to cut the bore hole wall.

9. A device according to claim 5 wherein the cutting member is fixed to a support body pivotally connected to and movable with a trailing end portion of the pivot lever in the plane of motion of the pivot lever about a pivot axis of means pivotally connecting the leading end portion of the pivot lever to the housing.

10. A device according to claim 9 wherein the exterior cutting surface of the cutting member has a radius of curvature that is larger than the curvature of an initial uncut bore hole wall and smaller than the curvature of a completely cut bore hole wall.

11. A device according to claim 9 wherein the trailing end portion of the pivot lever is pivotally connected to a trailing end portion of the support body.

12. A device according to claim 1 wherein the cutting member comprises:

a cutting body having a leading front surface including a cutting edge of a predetermined contour which protrudes from the outer diametral surface of the pivot lever, and inclined surfaces adjoining and extending inwardly away from the cutting edge of the leading front surface and toward a trailing rear end surface at a predetermined relief angle.

13. A device according to claim 1 wherein the support housing has a plurality of cutting tools equally angularly displaced around its periphery and arranged in axially spaced circumferential planes of the support housing.

14. A device according to claim 1 wherein the actuating means comprises:

a first rotatable bushing with an external thread rotatably mounted on the support housing, a second rotatable and axially displacable bushing with an internal thread engaging the external thread and rotatably mounted on the support housing and which is adjustable relative to the first bushing by screwing, and a drive pin connected to the feed control rod and actuated by the second bushing for displacing the feed control rod relative to housing in response to relative movement between the bushings.

15. A device according to claim 1 wherein the actuating means comprises:

a tubular body telescopically arranged to move axially about an outer portion of the tubular support housing outside the bore hole and connected to axially displace the feed control shaft relative to the rotatable tubular support housing and the cutting tool.

16. A device according to claim 15 wherein the tubular body is slideably mounted on and connected to rotate with the tubular support housing.

17. A device according to claim 16 further comprising:

coupling means for connecting the tubular body to the rotary drive means to rotatably drive the tubular support housing.

18. A device according to claim 17 further comprising:

a guide bearing on the outer end portion of the tubular support housing within the tubular body and which extends about and guidingly engages with the axially displaceable feed control rod.

19. A device according to claim 15 further comprising:

a stop means mounted on the tubular support housing adapted for engaging an exterior surface about an entrance to the bore hole, positioning and maintaining the cutting tool and cutting member thereon at a desired predetermined depth in the bore hole and distance from the exterior surface about the entrance.

20. A device according to claim 19 wherein the stop means comprises:

an adjustable inner clamp ring adjustably clamped to and rotatable with the tubular support housing, and an outer stop ring rotatably mounted on the adjustable inner clamp ring having an end surface for engagement with the exterior surface about the entrance to the bore hole.

* * * * *